US005970538A

United States Patent [19]

Walker

[11] Patent Number: 5,970,538

[45] Date of Patent: Oct. 26, 1999

[54] PANTOGRAPHIC SUPPORT CONTROL MECHANISM

[75] Inventor: Dale Norman Walker, Wattlegrove, Australia

[73] Assignee: Borthwick Industries Pty Ltd., Australia

[21] Appl. No.: 08/849,649

[22] PCT Filed: Apr. 30, 1997

[86] PCT No.: PCT/AU97/00256

§ 371 Date: Jun. 6, 1997

§ 102(e) Date: Jun. 6, 1997

[87] PCT Pub. No.: WO97/40723

PCT Pub. Date: Nov. 6, 1997

[30] Foreign Application Priority Data

Apr. 30, 1996 [AU] Australia ..... PN9587

[51] Int. Cl.[6] ..... A47C 17/13

[52] U.S. Cl. ..... 5/17; 5/12.1; 5/182

[58] Field of Search ..... 5/3, 6, 7, 12.1, 5/17, 18.1, 59.1, 182, 927

[56] References Cited

U.S. PATENT DOCUMENTS

| | | | |
|---|---|---|---|
| 887,198 | 5/1908 | Kiewicz | 5/12.1 X |
| 1,085,695 | 2/1914 | Nathoo | 5/182 |
| 1,678,795 | 7/1928 | Thomas | 5/182 |
| 2,127,025 | 8/1938 | Graham | 5/182 |
| 2,168,982 | 8/1939 | Graham | 5/154 |
| 3,176,633 | 4/1965 | Balfour | 5/182 X |
| 4,384,379 | 5/1983 | Yamada | 5/182 X |
| 4,674,794 | 6/1987 | Pine | 297/85 |
| 4,826,243 | 5/1989 | Lawson | 297/85 |
| 5,354,116 | 10/1994 | May et al. | 297/85 |

FOREIGN PATENT DOCUMENTS

| | | | |
|---|---|---|---|
| 0547299 | 3/1932 | Germany . | |
| 2-86361 | 7/1990 | Japan | A47C 19/14 |
| 0331916 | 7/1930 | United Kingdom . | |
| 2085293 | 4/1982 | United Kingdom | A47C 1/034 |
| 2105981 | 4/1983 | United Kingdom | A47C 19/14 |

OTHER PUBLICATIONS

"Combination bed and bedside table", SU–A–1764621, Derwint Abstract. No. 93–318596/40, Sep. 30, 1992.

*Primary Examiner*—Michael F. Trettel
*Attorney, Agent, or Firm*—Ladas & Parry

[57] ABSTRACT

A pantographic support control mechanism (10) for use with furniture includes one or more pantographic linkages (16). The or each linkage (16) is mounted between a forward end (104) and a rearward end (26, 106). Extension of the linkage(s) (16) causes relative movement of the forward and rearward ends (104) (26, 106) away from each other whereas contraction of the linkage(s) (16) causes relative movement of the forward and rearward ends (104) (26, 106) towards each other. One or more support means (14) are pivotally mounted with respect to and at or near respectively one or more of the pantographic linkages (16). One or more corresponding urging means (12) are arranged to act between a pantographic linkage (16) and a respective support means (14) in a manner such that extension of the or each linkage (16) causes the or each urging means (12) to respectively act on its respective support means (14) to cause it to pivot from an inoperative position to an operative position.

19 Claims, 8 Drawing Sheets

PANTOGRAPHIC SUPPORT CONTROL MECHANISM

FIELD OF THE INVENTION

The present invention relates to a pantographic support control mechanism and specifically to a mechanism for controlling a support surface associated with a pantographic mechanism. The mechanism finds use with furniture and will be described primarily with reference to its use in convertible sofa beds, but it should be appreciated that the invention has much wider application. For example, the invention can find application with cupboards, armchairs, cabinets etc and, in addition, may find application beyond that of furniture.

BACKGROUND TO THE INVENTION

Pantographic mechanisms for use with furniture are known. The mechanisms are primarily used to transform a piece of furniture from one function into another function, usually the latter function being that of a bed. The pantographic mechanism is stored in a contracted position within the furniture piece in its primary function, and is released therefrom and moved into an extended position to transform the furniture piece into a second function (eg. as a bed, footrest, etc).

With some of the existing pantographic mechanisms employed with furniture, when the mechanism is brought into the extended position a plurality of transverse support planks or slats mounted to the mechanism may be brought into a horizontal orientation. The resulting upper surface then forms the basis of a support surface for a mattress, cushion(s) etc. Existing arrangements require the fastening of the support planks to and between respective arms of a pantographic linkage in a constrained manner so that in the extended position the support planks move into the horizontal orientation.

SUMMARY OF THE INVENTION

The present invention provides a pantographic support control mechanism for use with furniture including:

- at least one pantographic linkage that is mounted between forward and rearward ends such that extension of the linkage causes relative movement of the forward and rearward ends away from each other whereas contraction of the linkage causes relative movement of the forward and rearward ends towards each other;
- at least two supports that are each adapted for separate pivoting with respect to the pantographic linkage; and
- at least two corresponding urging elements, each arranged to act between the pantographic linkage and a respective support in a manner such that extension of the pantographic linkage causes each urging element to act on its respective support to cause it to pivot upwardly and in the same way as an adjacent support, from an inoperative position to an operative position.

Certain advantages follow from having the support pivotally mounted to the mechanism, for example, the support can be readily detached from the pantographic mechanism (eg. by employing a releasable pivotal mounting) for the purpose of replacement, repair etc. Also, the urging elements can function to stabilise the supports in the operative position. For example, where the support incorporates support slats forming a sofa-bed support surface for a mattress, the urging elements can function to stabilise this support surface in use.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
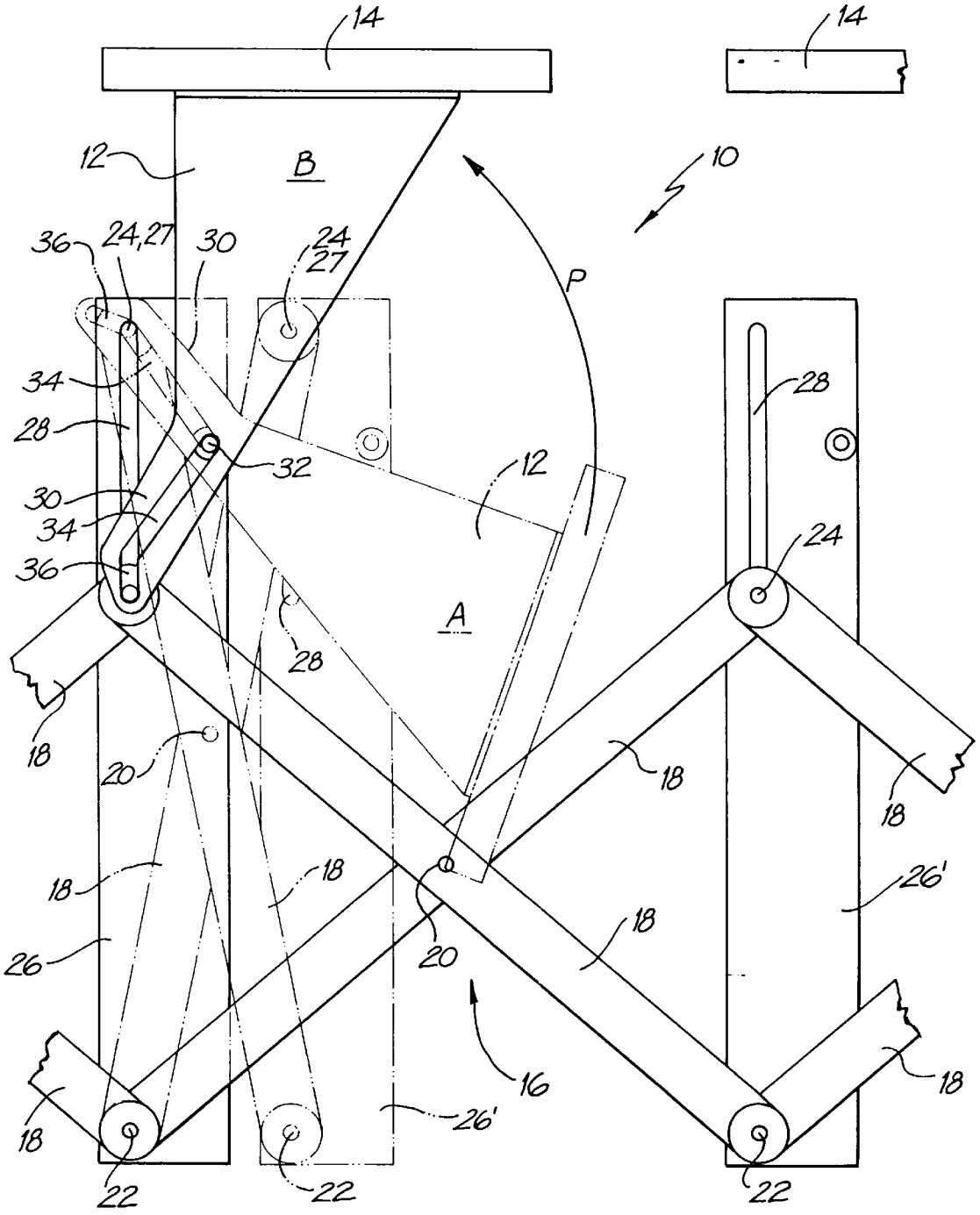
FIG. 1 shows a side elevation detail of one preferred pantographic support control mechanism

Referring to FIG. 1, a side elevation of a first embodiment of a pantographic support control mechanism is shown. Specifically, the mechanism is adapted for erecting the support surface and stabilising this support surface in the erected position. A most preferred application of this type of arrangement is in sofa-bed mechanisms, where the support surface is horizontally arranged and defines the horizontal bed support upon which a mattress can be arranged. However, the support control mechanism can also be used in other applications (eg. other furniture pieces) where pantographic mechanisms are employed and it is desirable to provide some type of stabilised support surface (of any inclination, eg. vertical, horizontal or inclinations therebetween).

In FIG. 1, a support mechanism 10 includes a support in the form of a modified bracket 12 supporting a plank or slat 14.

A pantographic linkage 16 includes a plurality of arms 18 pivotally coupled to other arms at intermediate pivot point 20 and lower and upper end pivot points 22,24.

For a given pair of arms (ie. the two criss-cross arms mounted intermediate their ends) the lower pivot points 22 are each mounted to a respective upright in the form of support post 26; (the lefthand support post is denoted 26 and the righthand support post is denoted 26').

The upper pivot points 24 each have a transverse pin 27 projecting therefrom for sliding receipt within a slot 28 formed in each support post.

In FIG. 1, the righthand support post 26' is shown in two positions, the leftmost position corresponding to the collapsed form of the pantographic linkage (where arms 18 are shown in dotted outline) and the rightmost position corresponding to the extended form of the pantographic linkage (with the arms 18 shown in hard outline). In the contracted form of the pantographic linkage each pin 27 sits in the upper end of slot 28, whereas in the extended form of the pantographic linkage, each pin 27 sits in the lower end of slot 28.

The modified bracket 12 has an urging element in the form of integral arm section 30 extending therefrom. The modified bracket is pivotally mounted to a respective support post via pivot screw 32. A second slot 34 is formed in the arm section 30 and extends from the pivot screw towards the free end of arm section 30; the second slot also has a kinked portion 36. The second slot is adapted for sliding receipt of pin 27 therethrough (pin 27 projecting both inwardly into slot 28 and outwardly into second slot 34).

The tilted down position A of the modified bracket 12 corresponds to the collapsed position of the pantographic linkage where pin 27 is positioned at the top of slot 28 and in the unkinked portion of second slot 34. However, as the pantographic linkage is extended, the pin 27 travels downwardly in slot 28 and also into the kinked portion 36 of second slot 34, at the same time causing the modified bracket to pivot about pivot screw 32 to be urged into position B, (this direction of pivoting being indicated by arrow P in FIG. 1). A similar occurrence is achieved for each successive modified bracket on each successive support post.

The retention of pin 27 in the kinked portion tends to provide a temporary locking function to the support mechanism when in position B, thus enhancing the stability of the bracket in this position (and hence the stability of any slats 14 mounted thereon). Accordingly, the support control mechanism when employed in a sofa-bed can provide structural stability for a wide variation in user weight and usage.

Figure 2:
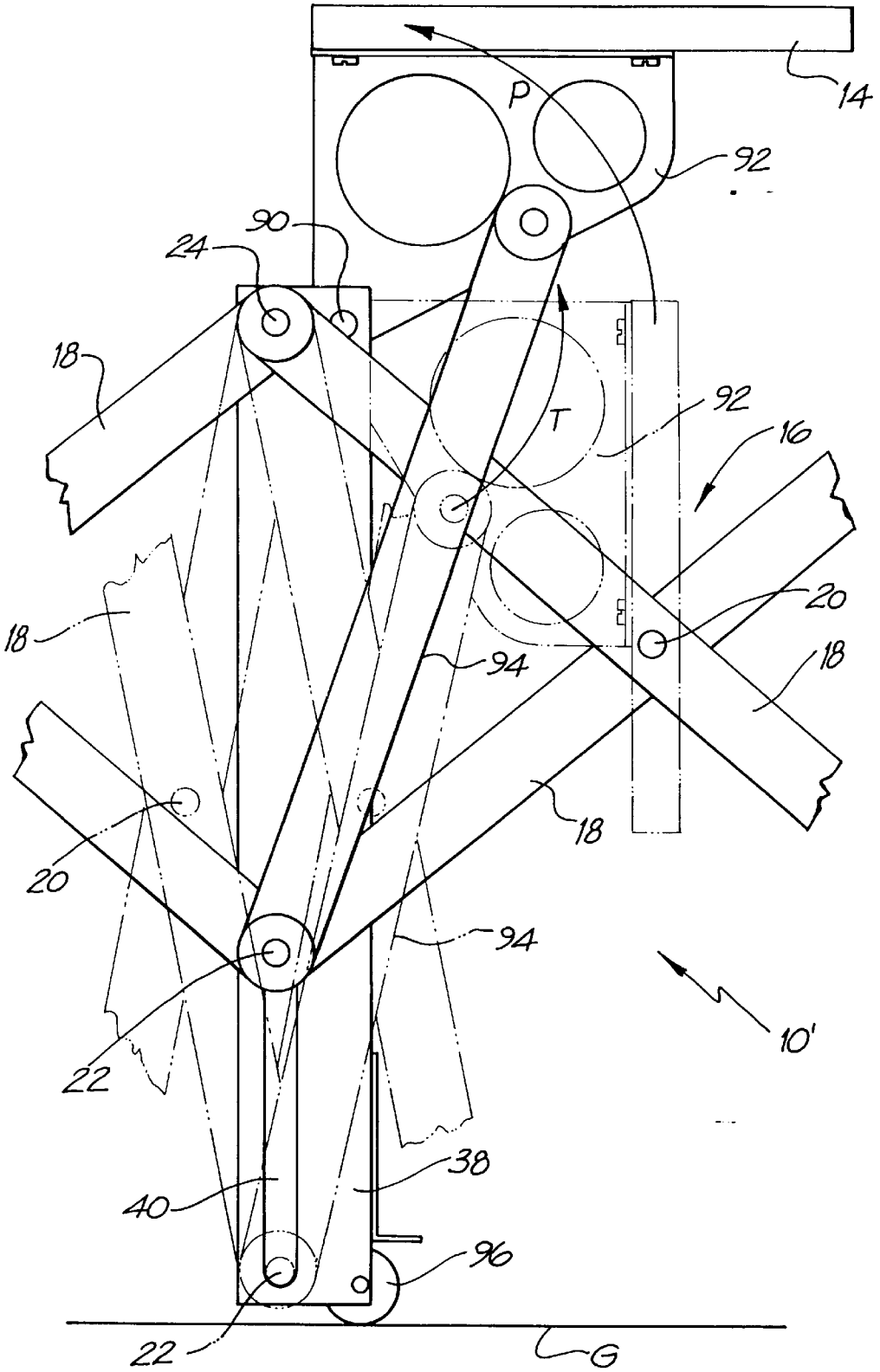
FIG. 2 shows a side elevation detail of another preferred pantographic support control mechanism according to the invention.

Referring to FIG. 2, a partial side elevation of an alternative pantographic support control mechanism is shown. Like reference numerals will be used to describe similar or like parts to those of FIG. 1.

In the alternative support control mechanism 10', a modified support post 38 is provided. This support post (and the support post shown in FIG. 1) can be arranged on either side of a transversely extending frame (ie. that extends between parallel pantographic linkage mechanisms, not shown). The mechanism in FIG. 2 is, once again, used for urging and supporting slat 14 into the horizontal position as the linkage 16 is moved into the extended position.

The slat 14 is pivotally mounted to the support post 38 at a pivot point 90 via a support means in the form of bracket 92. Each slat can be mounted to the bracket 92 via conventional screws etc as shown. The slat 14 can be pivoted about vertical strut 38 as indicated by arrow P. Pivotally mounted to and extending between bracket 92 and lower pivot point 22 is an urging element in the form of coupling arm 94.

Once again, the contracted form of the arms 18 is shown in dotted outline and the extended form of arms 18 is shown in hard outline. As the linkage 16 is moved to the extended position, lower pivot point 22 slides upwardly in a groove 40 formed in post 38 (eg. by providing a projecting lug or pin from pivot point 22 that slides within groove 40). During this extension post 38 is also displaced to the right, as facilitated by a roller 96, which rolls over the ground generally indicated as G.

Coupling arm 94 is selected to be of a stiff inflexible material so that as the lower pivot point 22 is caused to move upwardly during linkage extension. The coupling arm is also caused to move upwardly and acts upon the bracket to cause it to pivot in the direction indicated by arrow P. The mounting of coupling arm 94 to the bracket also travels in a similar manner (as indicated by arrow T). In the fully extended position, a stable arrangement of the slats 14 is achieved because each is maintained generally horizontal through the action of the coupling arms on respective brackets. Also, if it is desired to remove the support slats for replacement, repair etc, this can be readily and easily facilitated using the arrangement shown.

The travel of lower pivot point 22 can be arrested at the upper end of groove 40 by providing a short laterally (ie. sideways) extending groove portion and respective notch fixing formation (not shown) that is adapted for receiving in a releasable manner, a lug or pin projecting from pivot coupling 22 and that would be received therein when the mechanism is displaced to the extended position.

This additional feature further enhances the stability of the slats 14 when in the upper or raised position by providing a locking function against any generally downwards force exerted by a user on the support slats.

Figure 3:
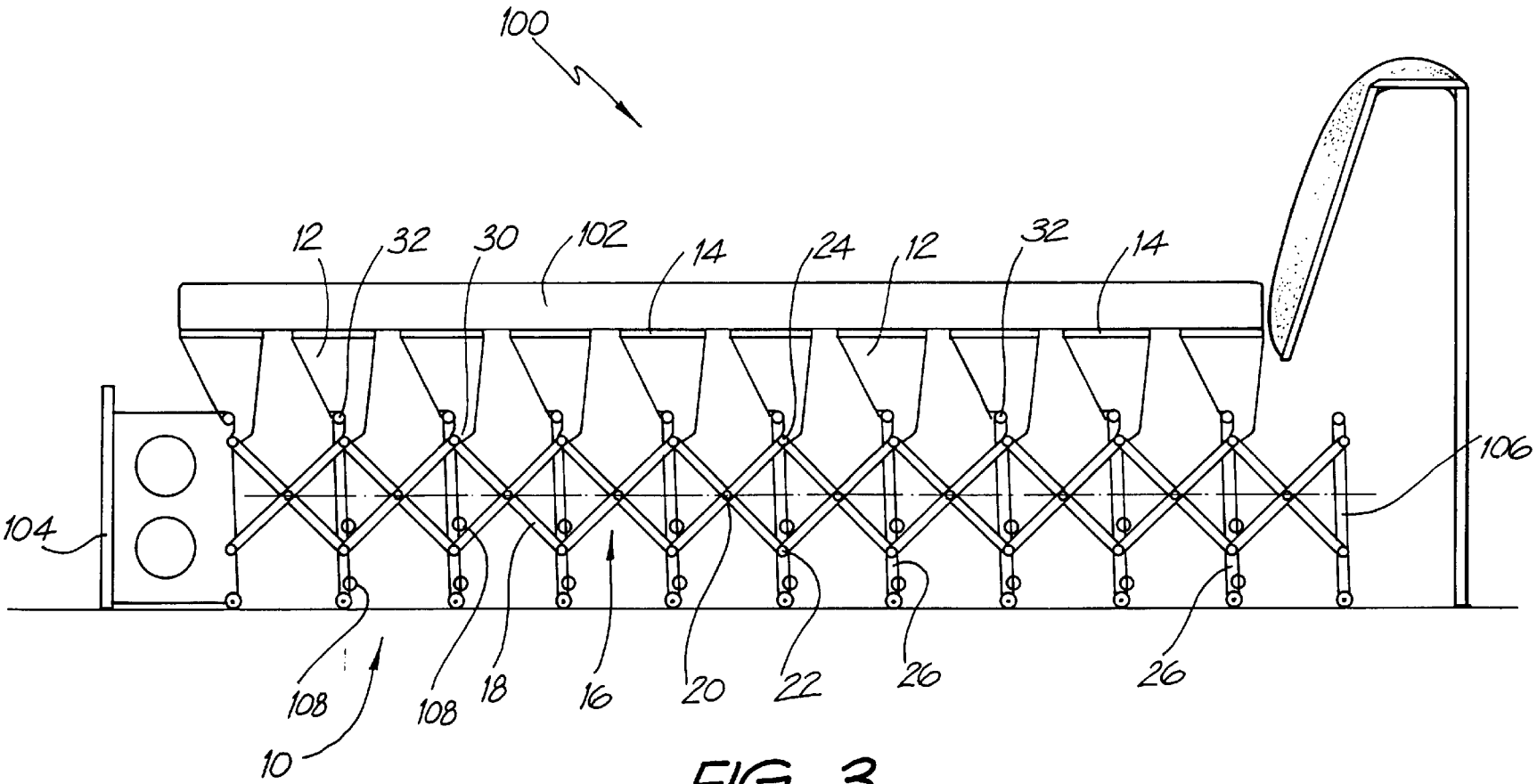
FIG. 3 shows a side elevation of another preferred pantographic support control mechanism according to the invention, similar in principle to the arrangement shown in FIG. 1, and when used on a sofa-bed and in the extended position.
Figure 4:
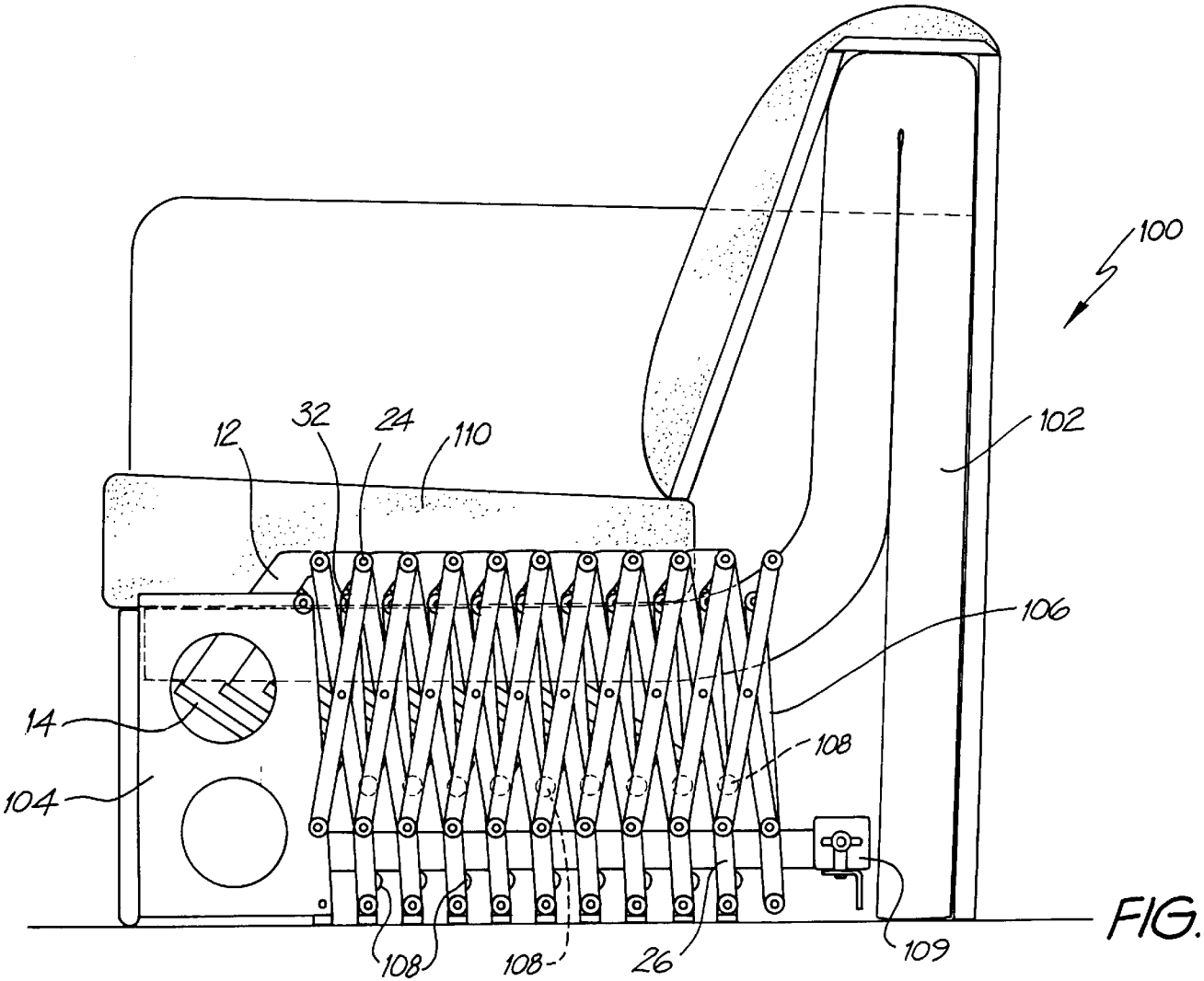
FIG. 4 shows a side elevation of the mechanism of FIG. 3, but when in the contracted position.

Referring to FIGS. 3 and 4, where like reference numerals will be used to denote similar or like parts, a mechanism similar to that shown in FIG. 1 is disclosed.

The mechanism 10 includes modified bracket 12 supporting plank 14. The pantographic linkage 16 includes a plurality of arms 18 pivotally coupled to other arms at intermediate pivot points 20 and lower and upper end pivot points 22, 24.

The mechanism is shown in a sofa-bed 100 that has a mattress 102 supported thereon, and the mechanism extends between front plate 104 and rear plate 106, with the rear plate being mounted to and/or integral with the frame of the sofa-bed 100.

The embodiment of FIGS. 3 and 4 is differentiated over that in FIG. 1, in that upper end pivot point 24 is not mounted and is freely movable with respect to support post 26. Thus, in the extended position of the mechanism shown in FIG. 3, each upper pivot point 24 is positioned generally below pivot screw 32 (ie. the screw that pivotally connects bracket 12 to the support post 26). In the contracted position shown in FIG. 4, however, each upper pivot point has been moved upwardly to a position generally above its respective pivot screw 32. This movement of the upper pivot point causes each bracket 12 to pivot around pivot screw 32 from the generally upright position shown in FIG. 3, to the generally collapsed position shown in FIG. 4 (ie. the upper pivot point acts on the arm section 30 of its respective bracket to cause it to pivot around pivot screw 32). Thus, the arrangement of FIGS. 3 and 4 provides a pivoting of the support bracket where the employment of slots in support posts 26 are not required.

Either of the bracket 12 and/or the upper pivot point 24 can be provided with a projecting flange or lug (not shown) to engage with (and optionally lock against) its respective support post 26 when in the upright position shown in FIG. 3. This can serve to lock the mechanism in a predetermined extended position (if desired). The shaping and formation of the bracket 12 of FIGS. 3 and 4 is such that each can nest with adjacent brackets to assume the compact collapsed formation as shown in FIG. 4.

In addition, one or more tubular braces 108 can be employed that extend transversely across from and between parallel sofa-bed mechanisms (ie. between parallel linkages). Each tubular brace 108 is shown mounted to and extending between respective and opposing support posts 26. Equivalent tubular braces 108 are also more clearly shown in the embodiment of FIG. 7. The tubular braces tend to have an additional stabilising function to the mechanism.

A linear actuator 109 can also be provided to extend and retract the linkages between the collapsed and extended positions. Typically the actuator is mounted to a frame of the sofa-bed 100 and extends therefrom to engage front plate 104. The actuator can be electrically powered and remotely activated.

The arrangement of FIGS. 3 and 4 enables the mattress 102 to sit on the frame when in both the extended and collapsed positions, thus enabling a sitting mattress 110 to be placed thereover in the collapsed configuration (FIG. 4) for comfortable and easy use by a user.

Referring to FIGS. 5 through 9, an alternative support mechanism 10 that does not employ a support post 26 is shown; (in other respects, the mechanism is similar to that shown in FIG. 2). The mechanism includes an urging element in the form of coupling arm 94'. Each coupling arm is pivotally connected to a lower pivot point 22 at one end, and at the opposing end to the bracket 12 at support pivot point 112. The bracket 12, however, is pivotally mounted to upper pivot point 24 itself and at a different position from support pivot point 112.

The lower pivot points 22 are in turn provided with slide footings 114 pivotally mounted thereto, to facilitate sliding of the mechanism across the ground G during extension and contraction thereof.

Figure 5:
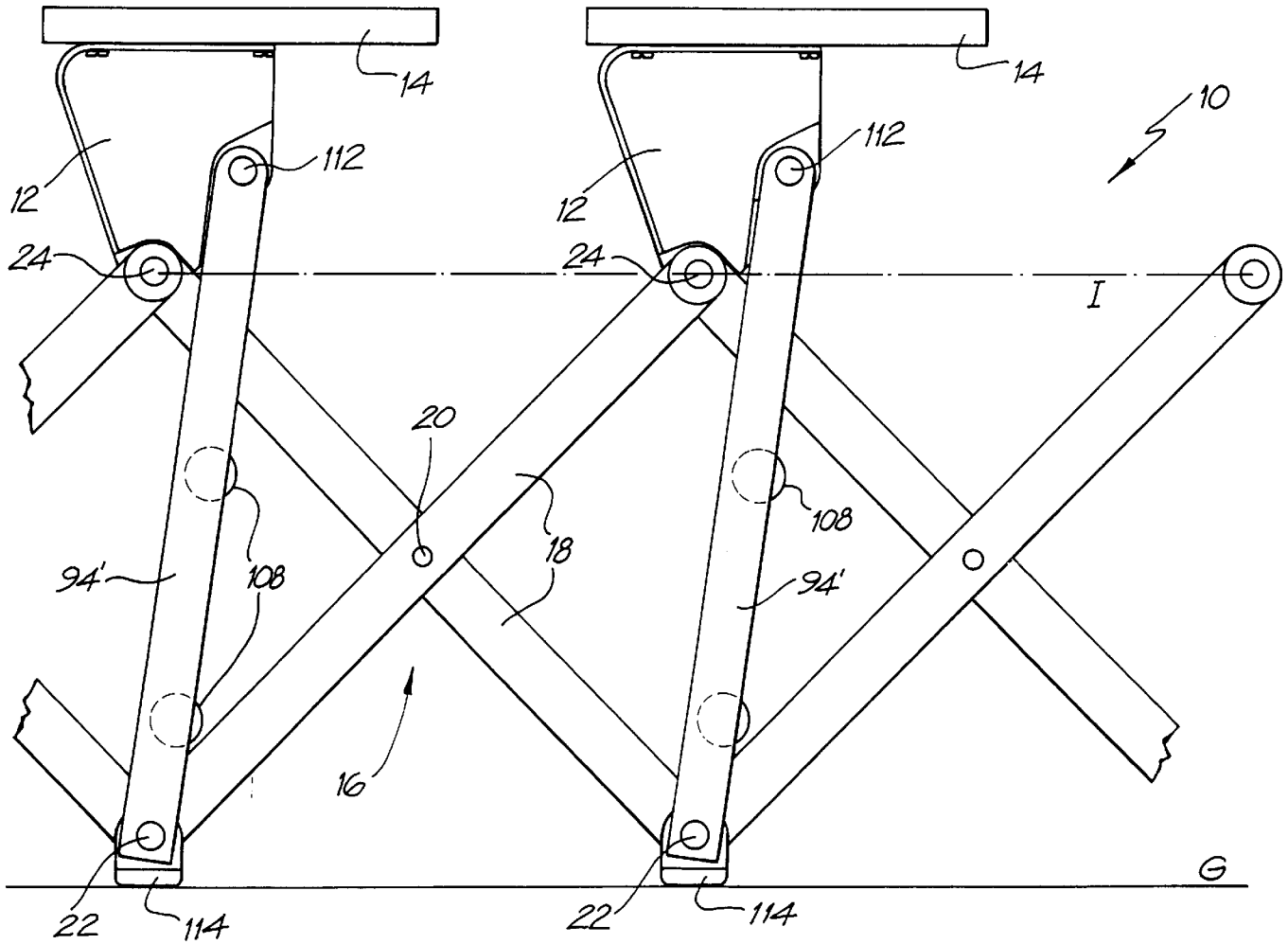
FIG. 5 shows a side elevation detail of another preferred pantographic support control mechanism according to the invention, and similar in principle to the mechanism of FIG. 2, but without the employment of support posts.
Figure 6:
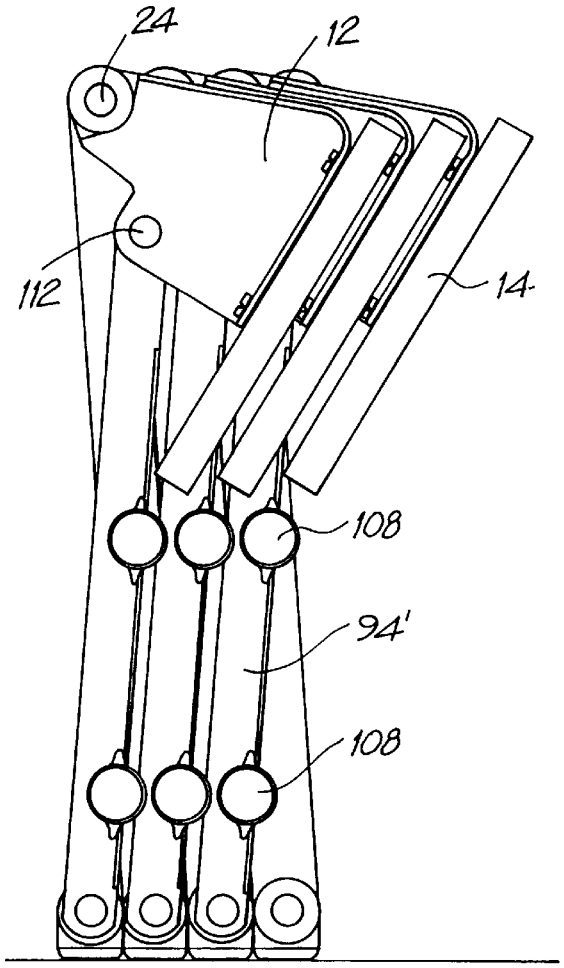
FIGS. 6, 7 and 8 show respectively side, front and plan detail elevations of the mechanism of FIG. 5 when in the contracted position.
Figure 7:
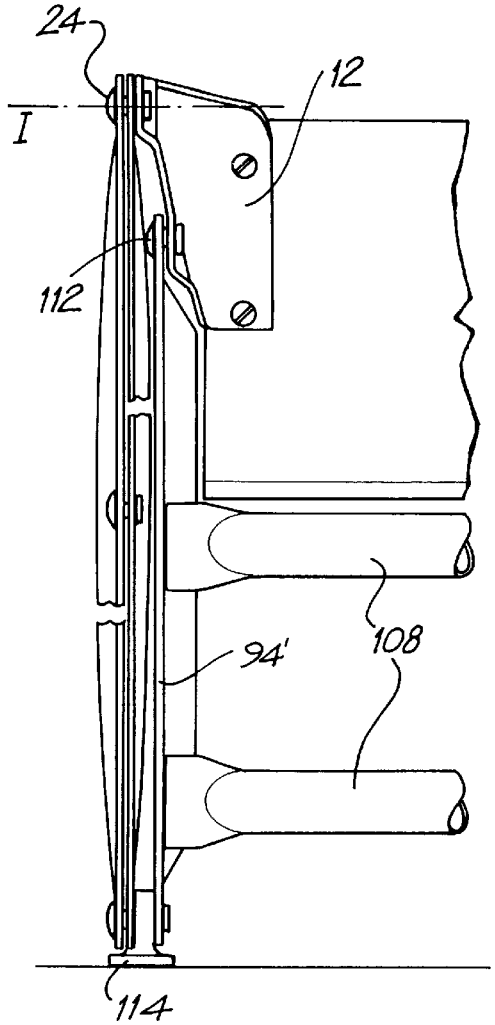
Figure 8:
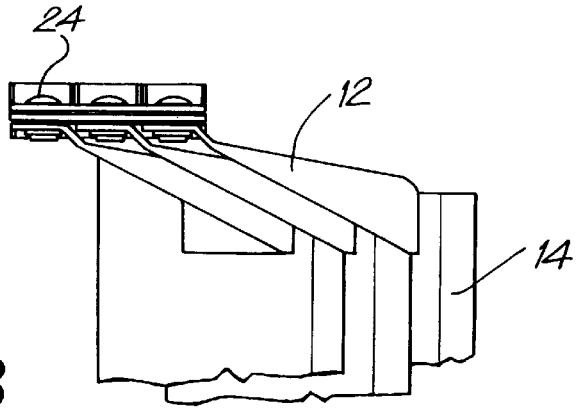
Figure 9:
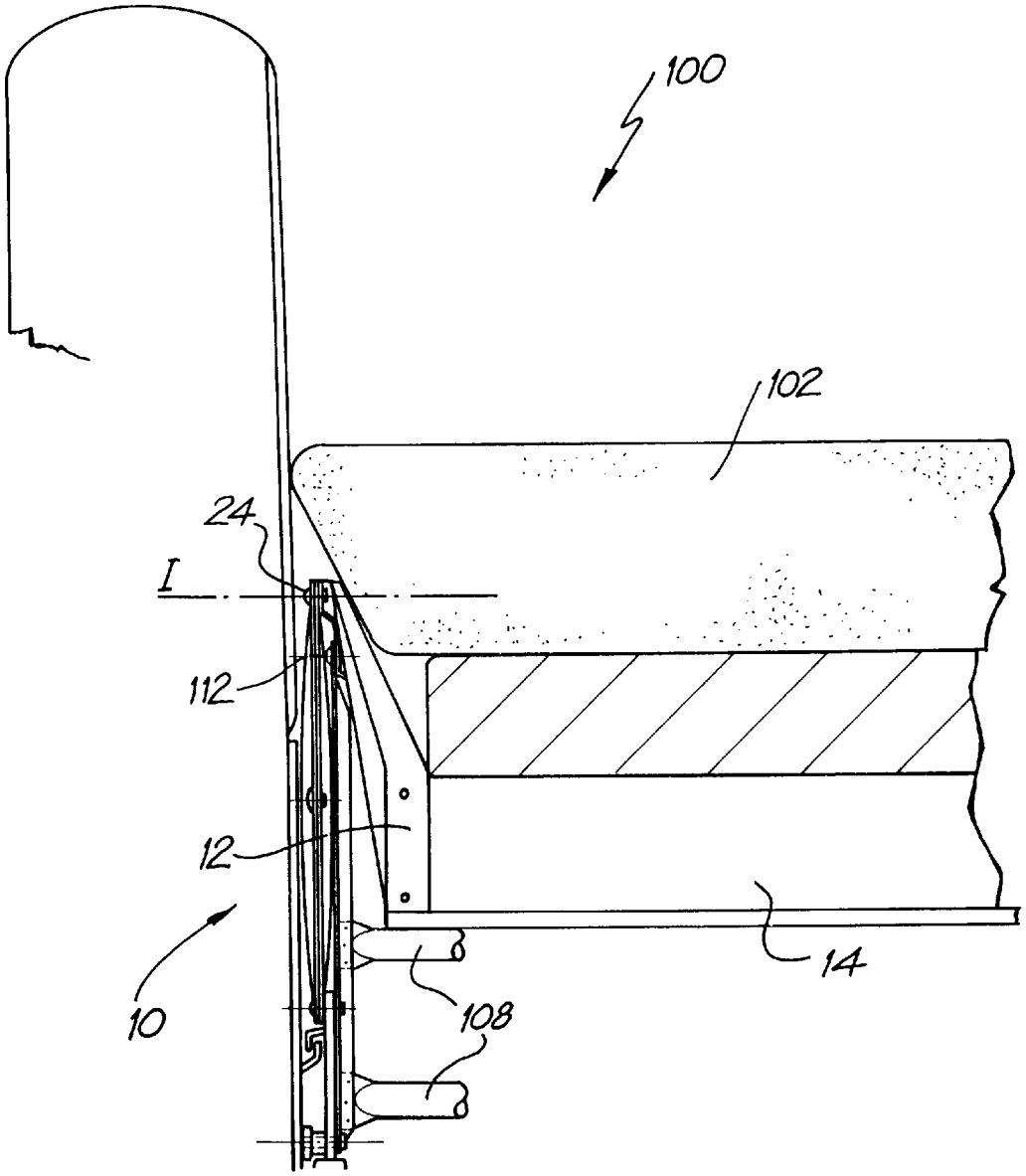
FIG. 9 shows a front detail of the mechanism of FIGS. 5 to 8 when employed in a sofa-bed mechanism.

It can be seen in FIG. 5 when the mechanism is in the extended position, that support pivot point 112 lies above an imaginary horizontal plane I passing through the upper pivot points 24. However, as shown in FIGS. 6 and 7 when the mechanism is in the contracted position, the support pivot point 112 lies below the imaginary plane I.

When two or more parallel support mechanisms are provided, the mechanisms can be generally stabilised by arranging a pair of tubular braces 108 between opposing and respective coupling arms 94'.

Thus, the mechanism of FIGS. 5 through 9 enables the provision of a pantographic furniture piece without the employment of support posts. Also, once again, each bracket 12 can be shaped such that it assumes a nested arrangement with other brackets in the contracted position (see in particular FIG. 6).

Figure 11:
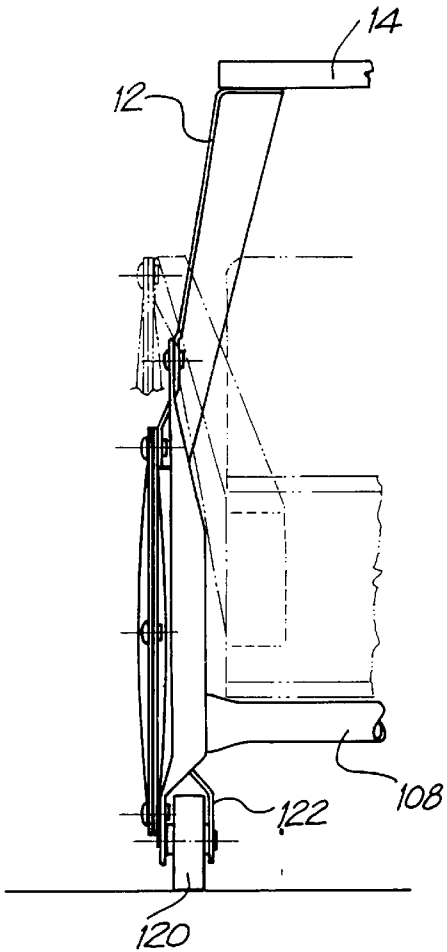
FIGS. 10 and 11 show respectively side and front detail elevations of a mechanism similar to FIGS. 3 and 4, but provided with roller feet.
Figure 10:
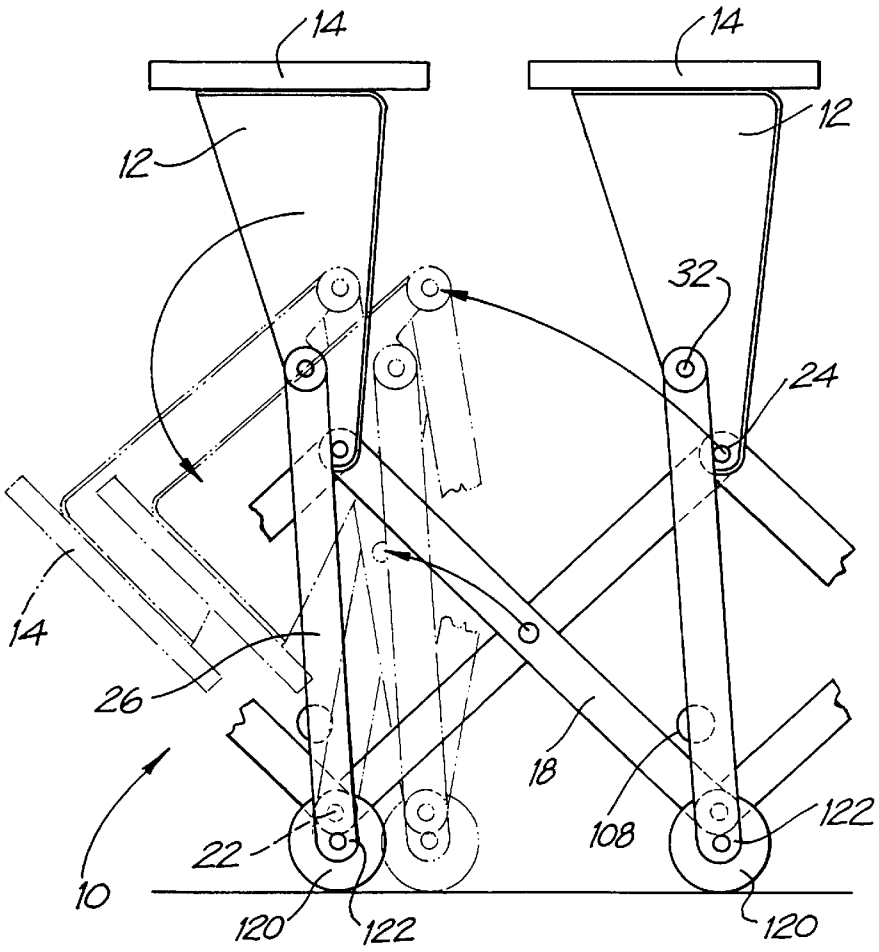

Referring to FIGS. 10 and 11, a mechanism 10 similar to that shown in FIGS. 3 and 4 is shown, however the support posts 26 extend slightly beyond lower pivot points 22 so that rollers 120 can be rotatably mounted to and within brackets 122 fixed to a respective support post. This arrangement eases the movement of the mechanism over supporting surfaces during both extension and contraction.

Certain general advantages are associated with the above arrangements. The support slats can be mounted to brackets of different sizes and thus height increases and/or decreases can be achieved without the need to vary the length of the posts 26,38 or the coupling or mounting of the arms 18 to the various supports.

The length of the coupling arms 94, 94' or arm section 30 can be made to vary (eg. each can be in the form of a gas strut, extendible link, pneumatic or hydraulic ram etc). This enables the support slat to be brought into the horizontal position earlier or later for different extension positions of the pantographic linkage mechanism. Thus, a relatively shorter or relatively longer bed may be achievable by varying the length of the coupling arm 94, 94' or arm section 30. However, appropriate arrangements may also be required with respect to the length of various slots and grooves (eg. to increase the upward travel of upper or lower pivot points 22,24, and variations in the coupling arm links may also be required).

Many of the components of the pantographic support control mechanism described above can be formed from metals such as aluminium, mild steel etc. Where possible and preferably, the components are formed from lightweight but strong plastic materials (eg. such as assisted gas plastics which are strong, light weight and easy to form).

Plastic materials are employed to minimise the cost and/or weight of the overall unit (eg. such as at the rollers, in the slats 14, in the brackets at coupling arm 94, arms 18, support posts 26,38 etc). The slats can also be formed from timber as can various other frame components.

The arrangements thus provide a compact, strong and stable collapsible mechanism, that is easy to use and form/manufacture.

Whilst the invention has been described with reference to a number of preferred embodiments, it should be appreciated that the invention can be embodied in many other forms.

I claim:

1. A pantographic support control mechanism for use with furniture including:

at least one pantographic linkage that is mounted between forward and rearward ends such that extension of the linkage causes relative movement of the forward and rearward ends away from each other whereas contraction of the linkage causes relative movement of the forward and rearward ends towards each other;

at least two supports that are each adapted for separate pivoting with respect to the pantographic linkage; and at least two corresponding urging elements, each arranged to act between the pantographic linkage and a respective support in a manner such that extension of the pantographic linkage causes each urging element to act on its respective support to cause it to pivot upwardly and in the same way as an adjacent support, from an inoperative position to an operative position.

2. A mechanism as claimed in claim 1, wherein each urging element is integral with its respective support and is pivotally mounted to the pantographic linkage.

3. A mechanism as claimed in claim 1, wherein each urging element is a free arm extending between its respective support and the pantographic linkage, the arm having one end pivotally mounted to the support and an opposing end pivotally mounted to the pantographic linkage.

4. A mechanism as claimed in claim 2 or claim 3, wherein the pantographic linkage includes a plurality of arm pairs mounted together in series, with each arm of each arm pair having opposing free ends, the free ends of arms of a given intermediate arm pair being pivotally joined to respective free ends of adjacent arm pairs on either side of the given arm pair, and wherein each support is pivotally mounted adjacent to a respective joint between adjacent arm pairs.

5. A mechanism as claimed in claim 4, wherein at least two uprights are provided between the forward and rearward ends and each support is pivotally mounted to a respective upright at a support pivot-mount for movement between the operative and inoperative positions, with the pantographic linkage being pivotally mounted to respective uprights at each respective joint and extending between a series of adjacent uprights.

6. A mechanism as claimed in claim 5, wherein forward and rearward members, that are generally vertically arranged in use, are arranged at the forward and rearward ends respectively, and wherein a pair of parallel pantographic linkages generally horizontally extend in use between the forward and rearward members and such that a given support in one linkage opposes a corresponding support in the other linkage; and wherein respective support planks are provided, each plank extending transversely between the pair of linkages and between respective and opposing joints, with each plank being mounted to opposing supports such that in the operative position each support pair orients its respective plank to present an upwardly disposed planar and generally horizontal face.

7. A mechanism as claimed in claim 6, wherein the in-use uppermost free ends of adjacent arms at each joint are adapted for sliding within a tracking formed in the upright in a generally vertical direction, whilst the in-use lowermost free ends of adjacent arms at each joint are pivotally mounted against sliding in the upright.

8. A mechanism as claimed in claim 7, wherein the tracking is a slot formed in the upright and the adaptation of the uppermost free ends includes a transversely projecting lug extendible therefrom and slidable within the slot, the lowermost free ends being mounted at or near the bottom of each upright, and the slot being arranged adjacent to the top of each upright.

9. A mechanism as claimed in claim 8, wherein the urging element includes a tracking along or in which the transversely projecting lug is caused to move during extension and contraction of the pantographic linkage, this movement causing the pivotal movement of each support between the operative and inoperative positions.

10. A mechanism as claimed in claim 9, wherein the urging element is an integral projecting arm extending away from the support pivot-mount of each support, and wherein the tracking in the urging element is a slot extending from the support pivot-mount to a remote end of the projecting arm and in which the projecting lug is slidably received.

11. A mechanism as claimed in claim 10 , wherein the slot is bent at a position near the arm remote end, such that the projecting lug travels into the bent portion of the slot when the respective linkage is brought into the extended position, resulting in a temporary locking of the support in the operative position.

12. A mechanism as claimed in claim 6, wherein the lowermost free ends of adjacent arms at each joint are pivotally mounted to a respective upright, whereas the uppermost free ends of adjacent arms at each joint are adapted for free movement with respect to the respective upright, such that in the extended position of the linkages each uppermost free end is positioned generally below the support pivot-mount, whereas in the contracted position of the or each linkage each uppermost free end is positioned generally above the support pivot-mount.

13. A mechanism as claimed in claim 6, wherein the lowermost free ends of adjacent arms at the joint are adapted for sliding within a tracking formed in the upright in a generally vertical direction, whilst the uppermost free ends of adjacent arms at each joint are pivotally mounted against sliding in the upright.

14. A mechanism as claimed in claim 13, wherein the tracking is a slot formed in the upright and the adaptation of the lowermost fee ends includes a transversely projecting lug extendible therefrom and slidable within a respective slot, the uppermost free ends being mounted adjacent to the top of each respective upright, and the slot being arranged adjacent to the base of each upright.

15. A mechanism as claimed in claim 14, wherein each support is pivotally mounted at a support pivot-mount located at the joint between uppermost free ends of the arm pairs, whereas the urging element is pivotally mounted, at one end to the joint between lowermost free ends of the arm pairs, and at the opposite end to a mounting position on the support remote from the support pivot-mount.

16. A mechanism as claimed in claim 15, wherein in the extended position of the linkage, the mounting position of the opposite end of the urging element is located above an imaginary horizontal plane through the support pivot-mount, whereas in is located above an imaginary horizontal plane through the support pivot-mount, whereas in the contracted position of the linkage the mounting position is located below the imaginary horizontal plane.

17. A mechanism as claimed in claim 16, wherein vertically extending forward and rearward members are arranged at the linkage forward and rearward ends respectively, and wherein a pair of parallel pantographic linkages extend generally horizontally between the forward and rearward members and such that a given support in one linkage opposes a corresponding support in the other linkage; and wherein respective support planks are provided, each plank extending transversely between the pair of linkages, between respective and opposing joints and being mounted to opposing supports, such that in the operative position each support pair orients its respective support plank to present an upwardly disposed planar and generally horizontal face.

18. A mechanism as claimed in claim 17, wherein opposing and corresponding urging element free arms in the parallel linkage pair each have a brace extending therebetween.

19. A mechanism as claimed in claim 1 for use in a furniture piece, to be stored therewithin when in a contracted position, wherein the mechanism can be displaced to an extended position to provide for a generally horizontal surface that forms the basis of, or functions as, a bed frame or together generally horizontal support frame.

* * * * *